US005628062A

United States Patent [19]

Tseng

[11] Patent Number: 5,628,062

[45] Date of Patent: May 13, 1997

[54] ARM AND HAND UV PROTECTION SLEEVE FOR DRIVING

[76] Inventor: Li Ming Tseng, 2206 S. 8th Ave., Arcadia, Calif. 91006

[21] Appl. No.: 570,356

[22] Filed: Dec. 11, 1995

[51] Int. Cl.[6] ..... A41D 13/08

[52] U.S. Cl. ..... 2/16; 2/59

[58] Field of Search ..... 2/16, 59, 60, 158, 2/161.6, 126, 269, 270; D29/113, 120

[56] References Cited

U.S. PATENT DOCUMENTS

| | | | |
|---|---|---|---|
| 214,796 | 4/1879 | Thompson | 2/16 |
| D. 299,562 | 1/1989 | Lee | 2/16 |
| 375,958 | 1/1888 | Skeffington | 2/16 |
| 925,952 | 6/1909 | Sacks | 2/59 |
| 2,150,069 | 3/1939 | Koleno | 2/59 |
| 2,394,136 | 2/1946 | Bakke | 2/16 |
| 2,683,878 | 7/1954 | Davila | 2/16 |
| 3,924,272 | 12/1975 | Allen et al. | 2/16 |
| 4,785,478 | 11/1988 | Mosley | 2/170 |
| 4,942,624 | 7/1990 | Cho | 2/16 |
| 4,967,419 | 11/1990 | Elliott | 2/16 |
| 5,056,157 | 10/1991 | Pryor | 2/16 |
| 5,070,541 | 12/1991 | Goss | 2/16 |
| 5,357,633 | 10/1994 | Rael | 2/16 |

FOREIGN PATENT DOCUMENTS

| | | | |
|---|---|---|---|
| 12188 | 6/1906 | United Kingdom | 2/16 |

*Primary Examiner*—Amy B. Vanatta

*Attorney, Agent, or Firm*—David & Raymond; Raymond Y. C. Chan

[57] ABSTRACT

An arm and hand ultra violet protection sleeve for driving includes a special graded fabric sun-block sleeve for UV protection while driving. The UV-proof sleeve is constructed of special graded soft and smooth irritation free fabric material, and with an elongated air ventilating chamber-like cavity extended from the upper arm portion down to the wrist area and from the wrist, a cuff extends in arch over the back of the hand which ends over the tip of the fingers, and with fastening elements and openings to both ends, so that the sleeve can be held in place gently and worn comfortably while driving. The UV protection sleeve can effectively narrow down and reduce the chance of drivers contracting any type of skin damage or health hazardous skin diseases from the intrusion of ultra violet radiation.

19 Claims, 7 Drawing Sheets

ARM AND HAND UV PROTECTION SLEEVE FOR DRIVING

BACKGROUND OF THE PRESENT INVENTION

The present invention relates to an arm and hand protective sleeve that helps preventing automotive drivers from contracting any type of skin damages or health hazardous skin diseases from the intrusion of the ultra violet radiation while driving. The scientific construction of the sun block sleeve eventually prohibits the intrusion of the ultra violet radiation to the skin around the arm and hand area. The arm and hand UV protection sleeve not only provides a great deal of health hazardous protection against the ultra violet radiation, yet it can also stylishly carry out the tone of fashion for automotive drivers in today's modem society.

According to our scientific study today, the record and evidence shows that massive and long term exposure to sun light or ultra violet radiation can health hazardously damage and hurt healthy human skin. Due to the intense exposure of ultra violet radiation, human skin seem to have a greater chance of contracting skin cancer and many other skin diseases. Over the years, record reveals a high incline rate of people who had contracted skin cancer, and in most of the diseased cases evidence accurately proof that the problems were caused by the intense and long term exposure of ultra violet radiation.

In our economic society today, an average family would have at least two or more automobiles at home. Due to our working society and the convenience of the hi-tech automobiles, practically everyone drives to work. All average working adults step into their cars at least four times each day, driving off to work, driving to lunch, returning from lunch and finally driving home. This only proves that we spent most of our driving time in the day, unfortunately under the ultra violet radiation which would vastly increase our chance of contracting any type of skin damages or health hazardous skin diseases. In addition, due to a stressful working world today, many of us often take our love ones on long vacation drives on the weekends as an stress relieving trigger.

The creatively designed sun block sleeve is virtually a revolutionary product. The arm and hand UV protection sleeve is specially designed for the protection and convenience of all automobile drivers. The construction of the mitten comprises of high quality air ventilating fabric with the precision stitching of computerized machinery. The irritation free fabric material of the UV proof sleeve is a highly graded fabric that is direfully light in weight, which bestows a great deal of air ventilation for the arm while the sleeve is comfortably worn by the driver. Eventually the temperature within the cavity of the sleeve will remain a constant cool, balance and comfortable temperature. The sleeve is primarily a limber air flow pipette like elongated cavity that extend from the upper arm portion down to the lower wrist and hand area with elastic O-ring attachments to both ends, thus the mitten would prohibit the intrusion of the UV ray from malevolence of the skin around the upper arm area down to the tips of the driver's fingers.

Women today often distress over damaged, tanned and aging skin around the arm and hand areas, due to the outcome of massive UV exposure while driving. Generally, a common and practical thing for the women to follow up is to find themselves a way to revise and take care of their damaged skin, which in many cases the ending solution is to invest immensely among of money in skin care cosmetic products. As of all the cosmetic industries today, it is well known that the consumer goods are priced economically high. Not only the price to pay is considerably high, but yet numerous variety of the skin care product are contemplate as ineffectual manufacturing. The arm and hand UV protection sleeve is the solution to the aforesaid problem, as well as a sun block mitten that can be highly consider as an effective and affordable utility product. In addition to the skin damage and health hazardous skin diseases prevention, the mitten furnishes a great deal of convenience, due to its soft, foldable, light in weight and easy storage sun block fabric material. The artistry designed appearance of the UV protection mitten immensely projects the modem perspective of fashion, interval prohibiting the ultra violet radiation from intruding and malevolence of the skin around the driver's arm and hand while driving.

SUMMARY OF THE PRESENT INVENTION

The main object of the present invention is to provide automotive drivers an arm and hand UV protection sleeve which is a sun block protection sleeve that extends from the upper arm portion down to the finger tips, which helps prohibiting the intrusion of ultra violet radiation from the malevolence of the driver's arms and hands while driving.

Another object of the present invention is to provide an arm and hand UV protection sleeve which is a sun block protection sleeve over the automotive driver's arms and hands area, and at the same time the air ventilating fabric designed sleeve helps keeping a constant cool, balance and comfortable temperature within the cavity of the sleeve.

Another object of the present invention is to provide an arm and hand UV protection sleeve which is a sun block protection sleeve constructed of soft and smooth irritation free fabric material that is very light in weight for easy and comfortable wearing, in addition, the mitten can be easily fold and store, which brings the automotive drivers great conveniences.

Another object of the present invention is to provide an arm and hand UV protection sleeve for automotive drivers that can adequately prohibit the intrusion of UV radiation for the prevention of skin damages and contraction of health hazardous skin diseases, and moreover the sun block sleeve is more efficient and economically affordable comparing to the skin care cosmetic industries.

Accordingly, the present invention is an aesthetically designed UV proof sleeve that carries out the tone of fashion to merge into today's modem perspective society. The UV protection sleeve is created to fit, convenience and protect all automobile drivers, with a high point purpose of prohibiting the intrusion of ultra violet radiation from invading the skin around the driver's arms and hands. In addition, the sleeve is capable of reducing the high incline rate of skin diseased patients. The scientifically constructed sun block sleeve not only halt the UV intrusion from tanning, damaging and hurting health human skin, yet the sleeve helps maintaining a constant cool and balance body temperature for the driver, due to its air ventilating tubule design construction. Whereby, the present invention can be visualized as an revolutionary health product and a more appropriate solution to the aforesaid problem, in comparison to the cosmetic care industries. The arm and hand UV protection sleeve for driver is virtually a more economical and compatible choice. Besides the best solution for a problem would be to prevent one.

BRIEF DESCRIPTION OF THE DRAWINGS

FIG. 2*a* is a side elevation view of the hand piece of the above first embodiment according to the present invention, showing the wrist portion and the finger tip cuff segment with a fastening element there between.

DETAILED DESCRIPTION OF THE INVENTION

Figure 1B:
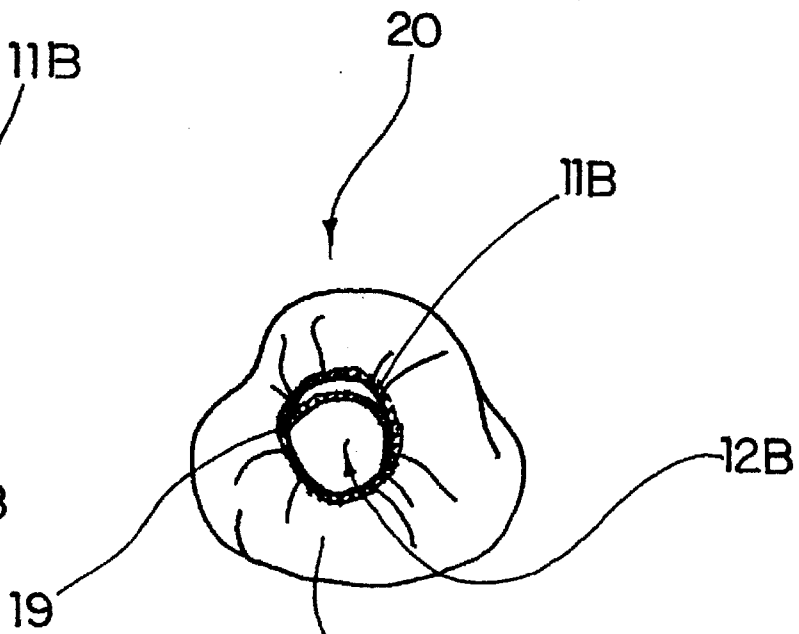
FIG. 1*b* is a front elevation view of the arm piece of the above first embodiment according to the present invention, showing the fastening elements.
Figure 1A:
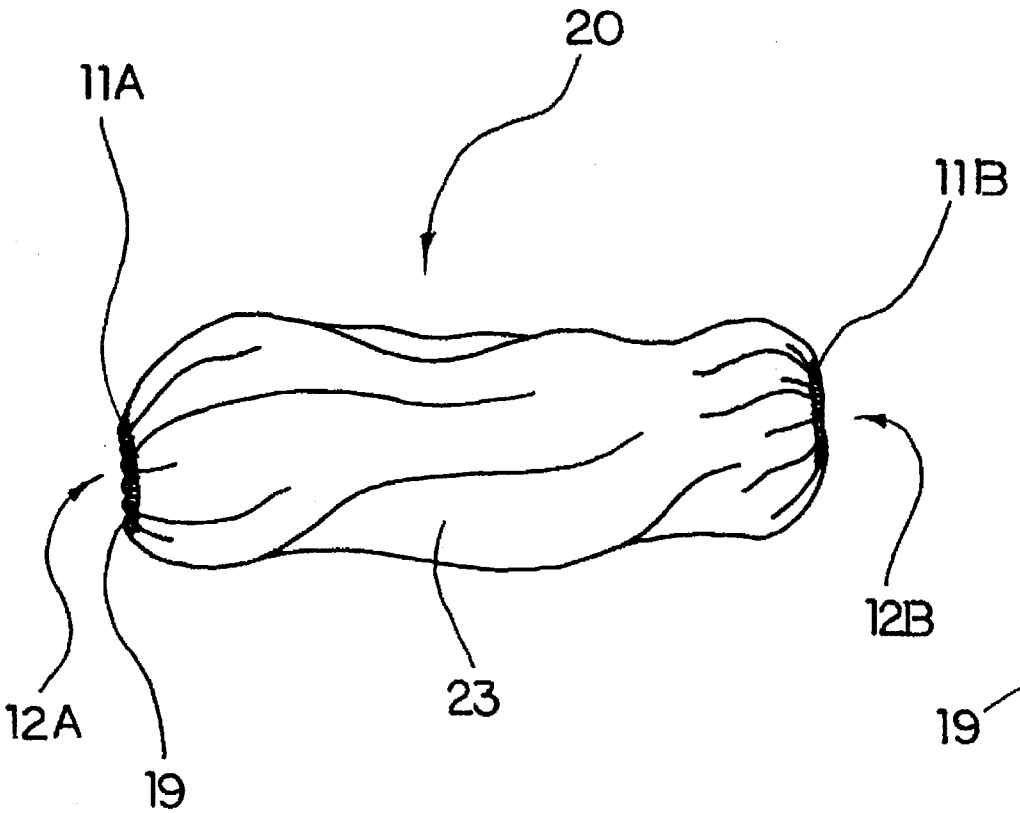
FIG. 1*a* is a side elevation view of the arm piece with fastening elements of a preferred first embodiment according to the present invention.
Figure 2B:
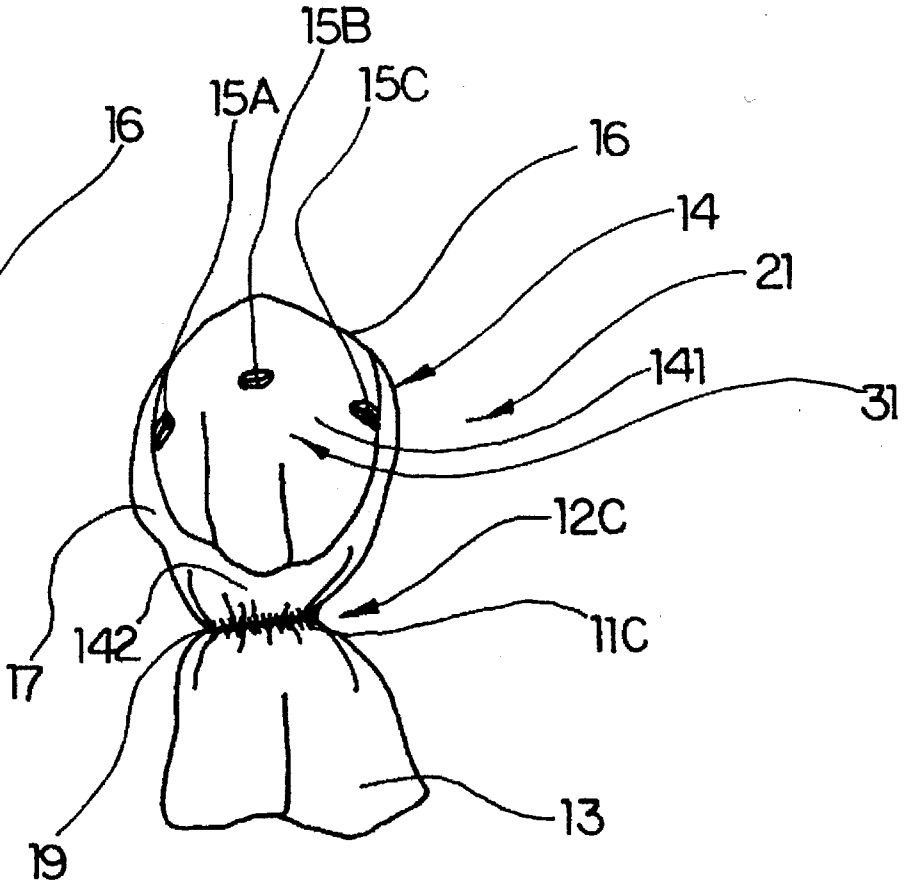
FIG. 2*b* is a bottom elevation view of the hand piece of the above embodiment according to the present invention, showing the cuff segment of the hand piece with finger band attachments disposed on the inner surface of the arc over hand cuff.
Figure 2A:
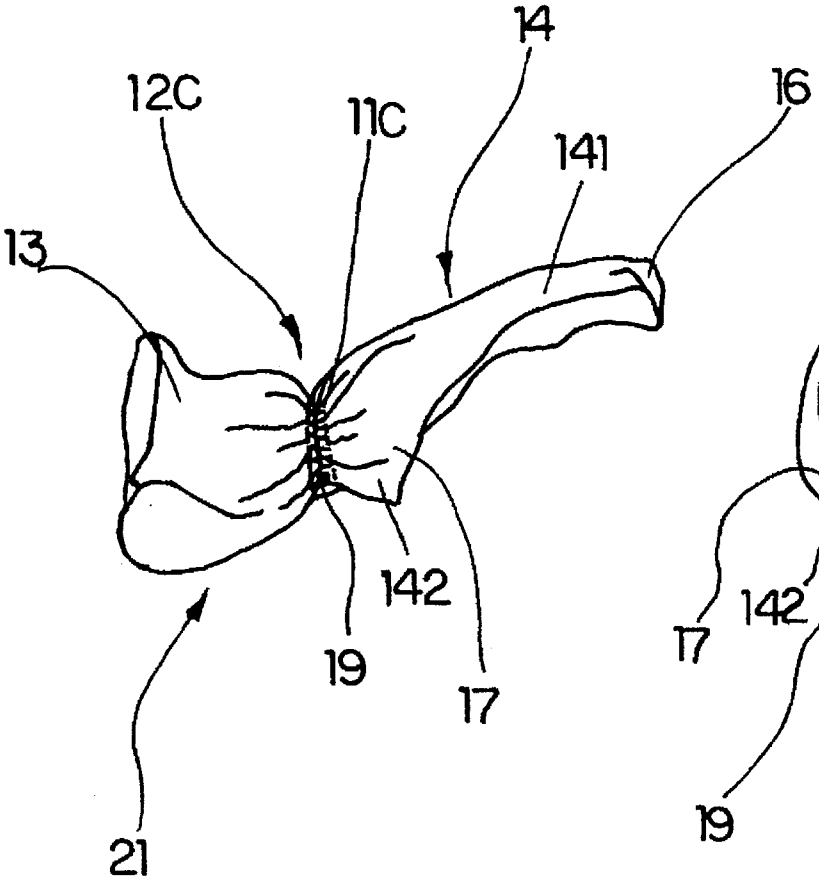

Referring to the FIGS. 1 and 2, an arm and hand ultra violet protective sleeve of the present invention is illustrated. The arm and hand protective sleeve includes an elongated flexible air ventilating fabric tubular arm piece 20 (as shown in FIGS. 1*a* and 1*b*) and a flexible air ventilating fabric hand piece 21 (as shown in FIGS. 2*a* and 2*b*).

According to the preferred first embodiment of the present invention, the arm piece 20 defines a chamber like cavity 18 therein and has two openings 12A, 12B at the two ends 11A, 11B of the arm piece 20 respectively. The arm piece 20 is adapted to extend from the rear arm down to the wrist area of a driver and is constructed with two fastening elements 19, such as an elastic band, velcro or snap-on strap, to each end 11A and 11B so as to fasten the rear end 11A to the upper portion of a driver's arm and the front end 11B to the wrist area of the driver for holding the arm piece 20 in adequate position.

Figure 5:
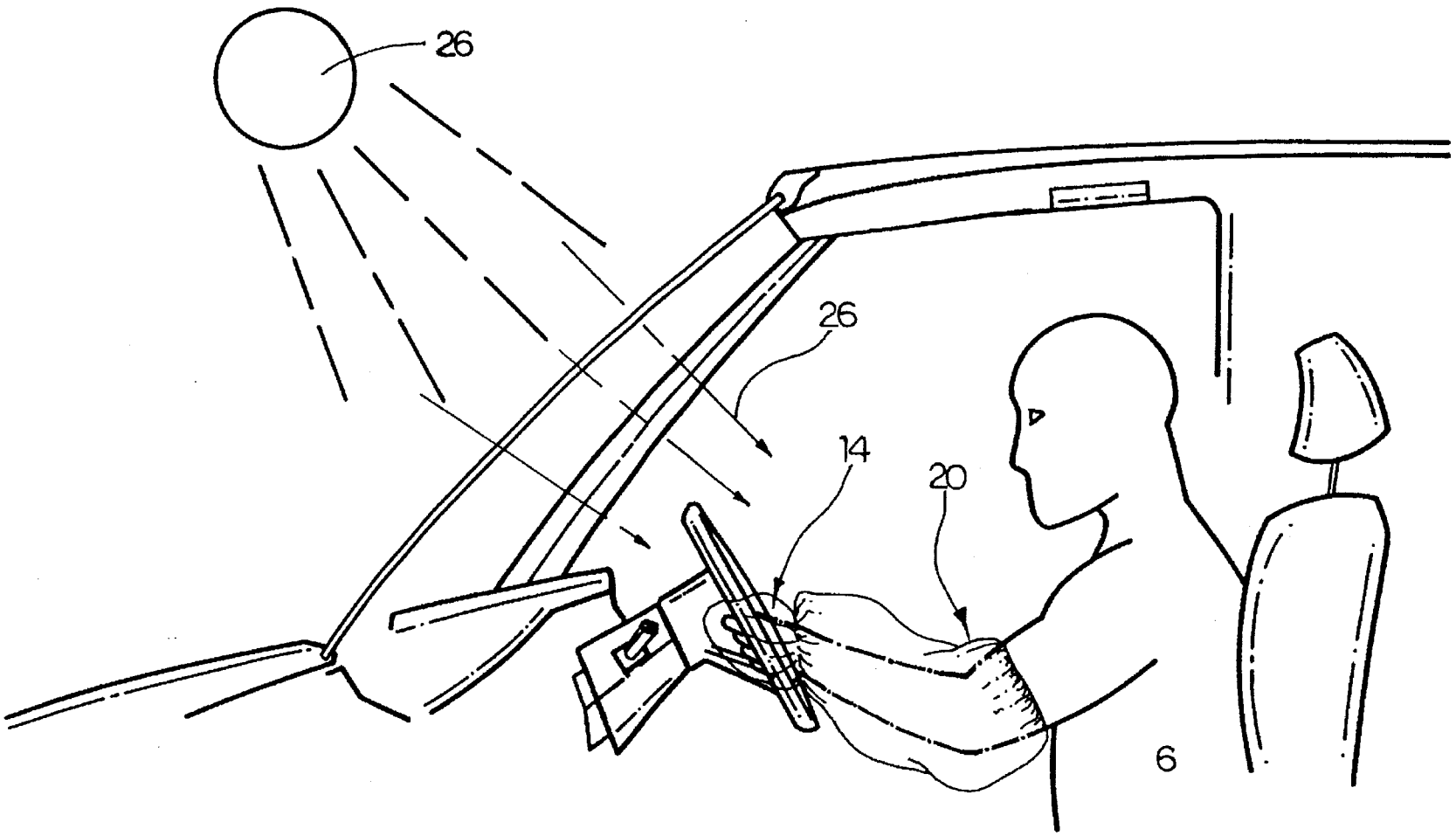
FIG. 5 is a perspective view of an arm and hand UV protection sleeve of the present invention, showing the garment worn over the arm and hand of a driver of a vehicle and the garment being held in fitting and comfortable position.

Referring to FIGS. 2*a* to 2*b*, the hand piece 21 comprises a prolonged tubular and segment 13 and a hood and arch like cuff segmen the prolonged arm segment 13 to a predetermined length that can overlap the entire back surface of the hand and fingers of the driver 5 with its fringe 16 ending over the tip of the driver's fingers for prohibiting the intrusion of the ultra violet radiation. As shown in FIG. 2*b*, the bottom side 142 of the cuff segment 14 just extends from the arm segment 13 to cover the wrist and palm area of the driver's hand so that the driver's hand is able to expose through an open mouth 30 formed under the top prolonged side 141 for grasping the steering wheel (as shown in FIG. 5). The hand piece 21 is made of special air ventilating fabric material 23 that helps to decrease the temperature underneath the arch like hand overlapping cuff segment 14. As shown in FIG. 2*a* and 2*b*, between the arm segment 13 and the cuff segment 14, a third fastening element 19 is constructed with precision stitching 11C of the hi-tech computerized machinery for holding the hand piece 21 to the driver's wrist area and overlapping the arm segment upon the front end 11B of the arm piece 20. In which the stitching 11C may intensify the bindings between the special fabric 23 and the elastic fastening elements 19 at the opening.

Figure 4:
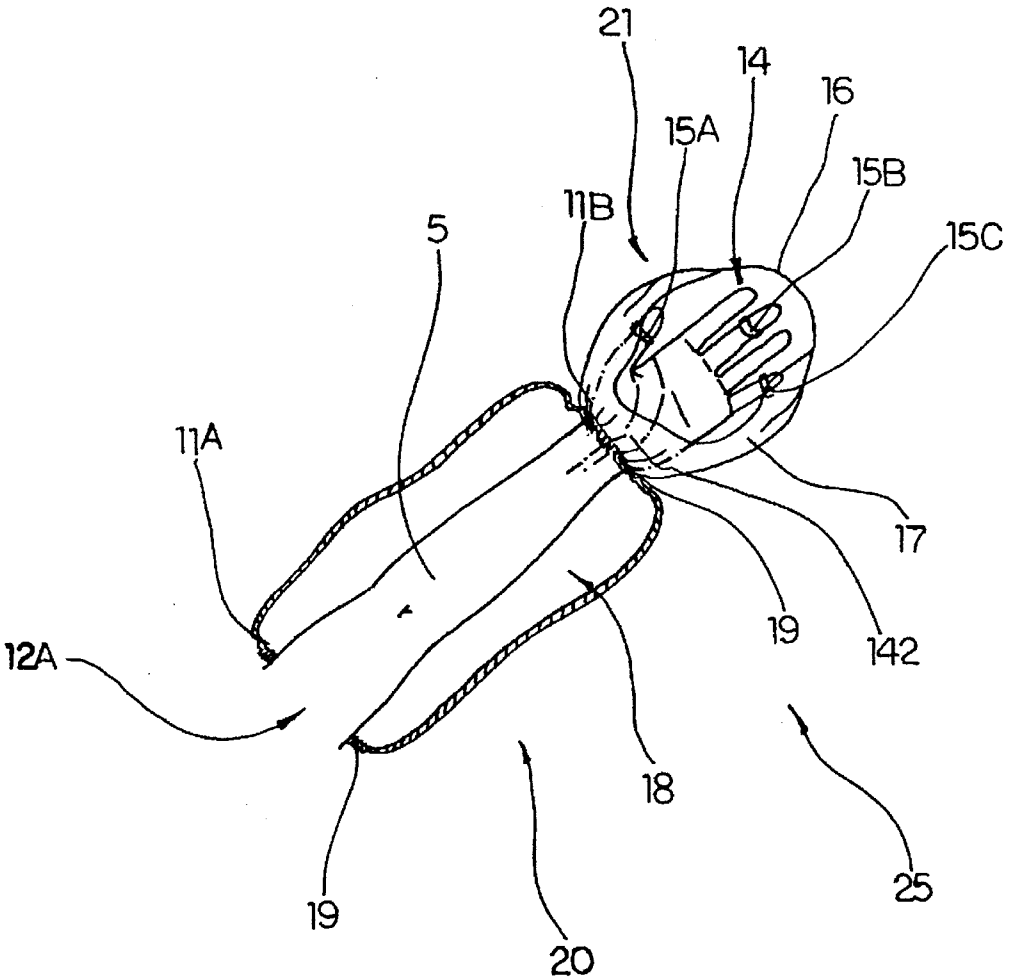
FIG. 4 is a partial sectional bottom view of the above second embodiment according to the present invention, showing the arm and hand of a driver in position with the present invention.

The cuff segment 14 of the hand piece 21 also comprise of at least a holding means 15 for connecting the cuff segment 14 to the driver's hand by mounting on the driver's finger(s). In accordance with the present embodiment, the holding means 15 comprises three elastic finger band attachments 15*a*, 15*b* and 15*c* disposed within and across the internal surface 31 of the top side of the cuff segment 14, in which two finger band attachments 15A and 15C are fixed near the side edges of the fringe 16 or the side skirt 17 and the other finger band attachment 15B is fixed at the center position of the internal surface 31 to provide more gripping stability for the driver's hand and fingers. As shown in FIG. 4, the driver's thumb, middle finger and little finger are penetrated through the finger band attachments 15A, 15B and 15C and the driver's hand is held in desired position underneath the cuff segment 14. Thus, the driver's hand is entirely sheltered by the cuff segment 14 with the edge of driver's hand covering by the fringe 16 and side skirt 17 of the cuff segment 14.

Due to the creatively designed overlapping hand piece 21, it not only bestows massive air ventilation from the open mouth 30 for the hand and fingers of the driver, but yet the soft and smooth irritation free fabric 13 can affect a great deal of comfort for the arms and hands. In addition, when the driver who has worn the arm and hand UV protection sleeve of the present invention has to leave the automobile for just a while, the driver can simply take off the hand piece 21 only. During winter season, the driver may wear long sleeve garment so that the driver can only dress the independent hand piece 21 on his or her wrist for sheltering his or her hand from sun shining and ultra violet radiation.

Both the arm piece 20 and the hand piece 21 are made of special soft, smooth and irritation free fabric material 23, due to its fabric material 23 and the tubular cavity 18 as shown in FIG. 4, the condition of the temperature within the tubular cavity 18 will stay a constant cool, balance and comfortable temperature, meanwhile the arm piece 20 extends and protect directly from the upper arm or the upper biceps area or the rear end opening 12A down toward the front opening 12B with the fastening elements 19 attached to both ends 11A and 11B. The air ventilating fabric 23 gently wraps around the overlapped portion of the whole arm 5 of the driver 6, as shown in FIGS. 4 and 5, in which the fabric 23 enables a constant balance of air circulation within the cavity 18 of the arm piece 20. The openings 12A and 12B toward the two ends of the arm piece 20 are reinforced with the O-ring like elastic bands 19, where around the reinforcing elastic bands 19 are high point computerize machine stitching 11C to enable an efficient settings for the fastening elements 19, by means and the purpose of the fastening elements 19 furnishes a great potential of gripping, holding and supporting duties for the arm piece 20

Figure 3:
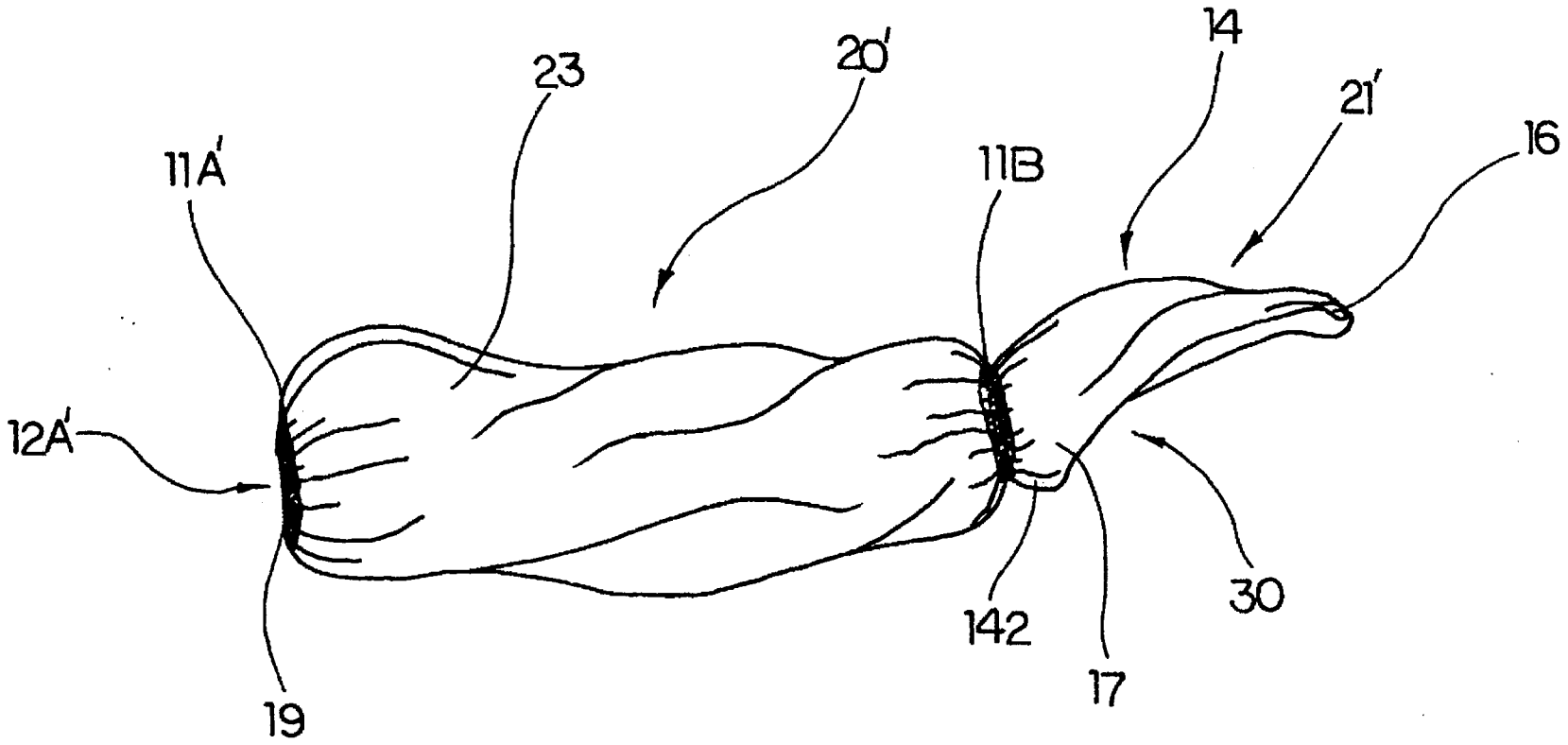
FIG. 3 is a side elevation view of a preferred second embodiment according to the present invention.

In accordance to a second embodiment of the present invention, as shown in FIGS. 3 to 5, an integrally constructed arm and hand UV protection sleeve is illustrated which also comprises an arm piece 20 and a hand piece 21 constructed in one piece. The tubular arm piece 20 has a rear opening 12A at its free rear end 11A and extends forward to a front end 11B to define a front opening 12B and an interior chamber like cavity 18 between the rear and front ends 11A and 11B. Two fastening elements 19, such as elastic bands, velcros or snap-on straps are constructed at the rear and front ends 11A and 11B respectively so as to fasten the rear end 11A to the upper portion of the driver's arm and the front end 11B to the driver's wrist area for holding the arm piece 20 in desired position. The fastening elements 19 are two elastic bands, as illustrated in the present second embodiment and Figures, which are bound to the rear and front ends 11A and 11B **12*b*** with computerize machine stitching.

The hand piece 21 comprises a cuff segment 14 integrally extends from the front end 11B of the arm piece 20 so as to form a one-piece complete arm and hand UV protection sleeve. The configuration of the cuff segment 14 is the same of the cuff segment of the independent hand piece disclosed in the above mentioned first embodiment.

The UV protection sleeve is worn by extending from the rear opening end 11A which hold and position in place by means of elastic band 19 at the upper arm portion down to the opposite or front sleeve opening end 11B which fasten fittingly and gently at the wrist area, while at the front opening end 11B with the cuff segment 14 that arches over and overlaps the back of the hand with the fringe 16 ending over the tip of the driver's fingers. Therefore the whole arm and hand can be safely protected by the independent arm piece 20 and hand piece 21 as illustrated in the first embodiment or by the integral single piece sleeve as illustrated in the second embodiment of the present invention.

As shown in FIG. 5, the driver is in a common driving position comfortably wearing a pair of the single piece overall ultra violet radiation protection sleeves, as the FIGS. 4 and 5 clearly show the sleeve fittingly extended from the upper arm portion down and over to the tip of the driver's fingers, while the arm pieces 20 and cuff pieces 21 are protecting the driver's arms and hands from the sun 26.

As briefly described and referring particularly to FIG. 3, FIG. 4 and FIG. 5, the single piece sleeve is an detail constructed sun block garment that will protect and convenience all automobile drivers, with construction of soft and smooth irritation free foldable fabric material 23, the sun block protection sleeve of the present invention can be easily folded smaller and for an easy storage anywhere at any time, meanwhile, the fabric material 23 is also immensely light in weight therefore of great storage conveniences, the one size fit all design of the sleeve makes it easier for all automotive drivers, wherein the size variety is due to the flexible fabric material 23 that can be easily fold and adjusted while it's put on. As shown in FIG. 4, the arm 5 and hand are in perfect fitting position. It also clearly shows the cavity 18 between the forearm 5 and the sleeve, in which air circulation can be taken place and the temperature would maintain and uphold a constant balance and comfortable body temperature. In FIG. 5 clearly shows the ultra violet radiation protection sleeve 25 being worn by a driver 6 in a fitting and comfortable position, as of the sleeve is showing its purpose and effectiveness of ceasing and prohibiting the intrusion of ultra violet radiation from sun 26.

Figure 6A:
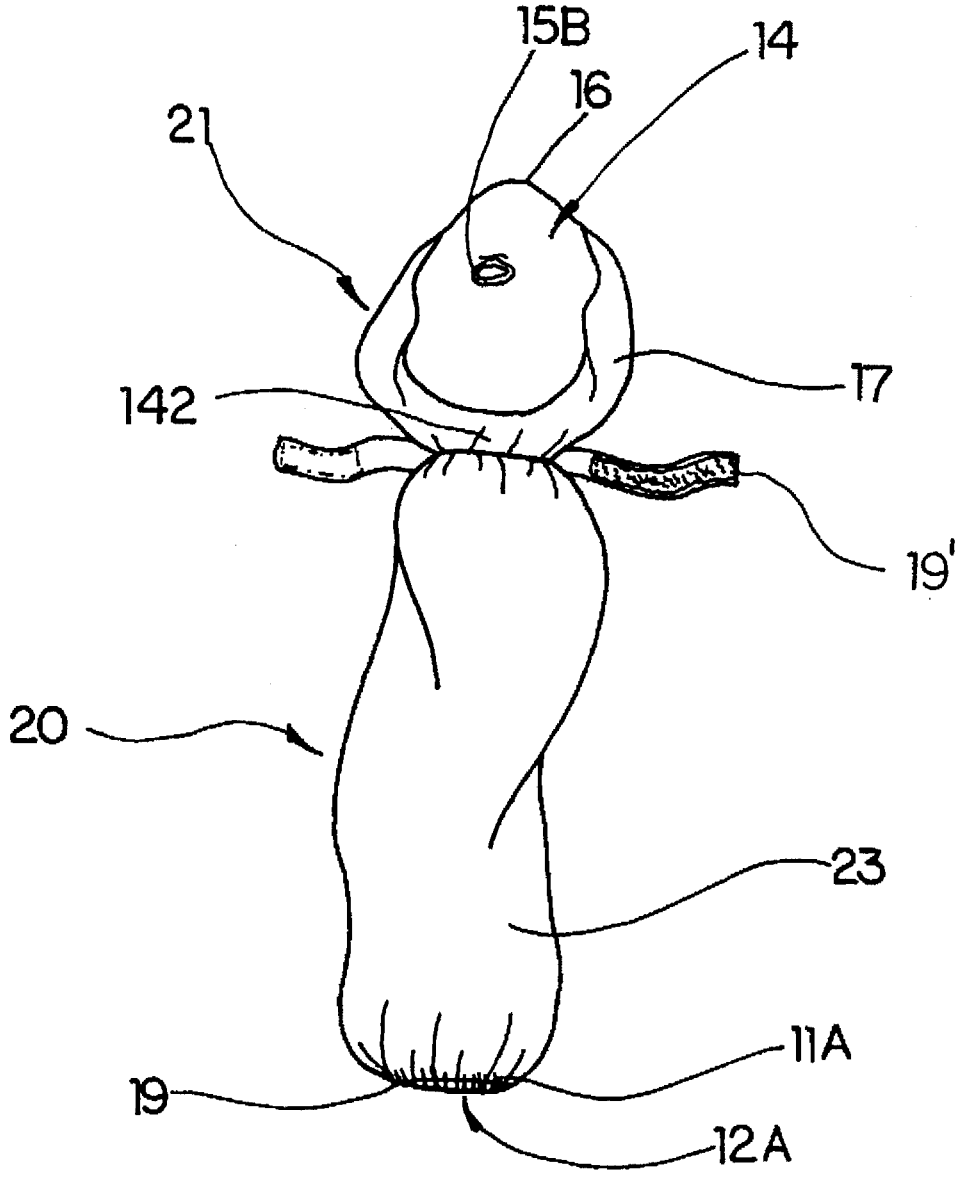
FIG. 6*a* and 6*b* are perspective views of an arm and hand UV protection sleeve of the present invention, in which the fastening elements are hook and loop fasteners such as VELCROS and snap-on straps respectively.
Figure 6B:
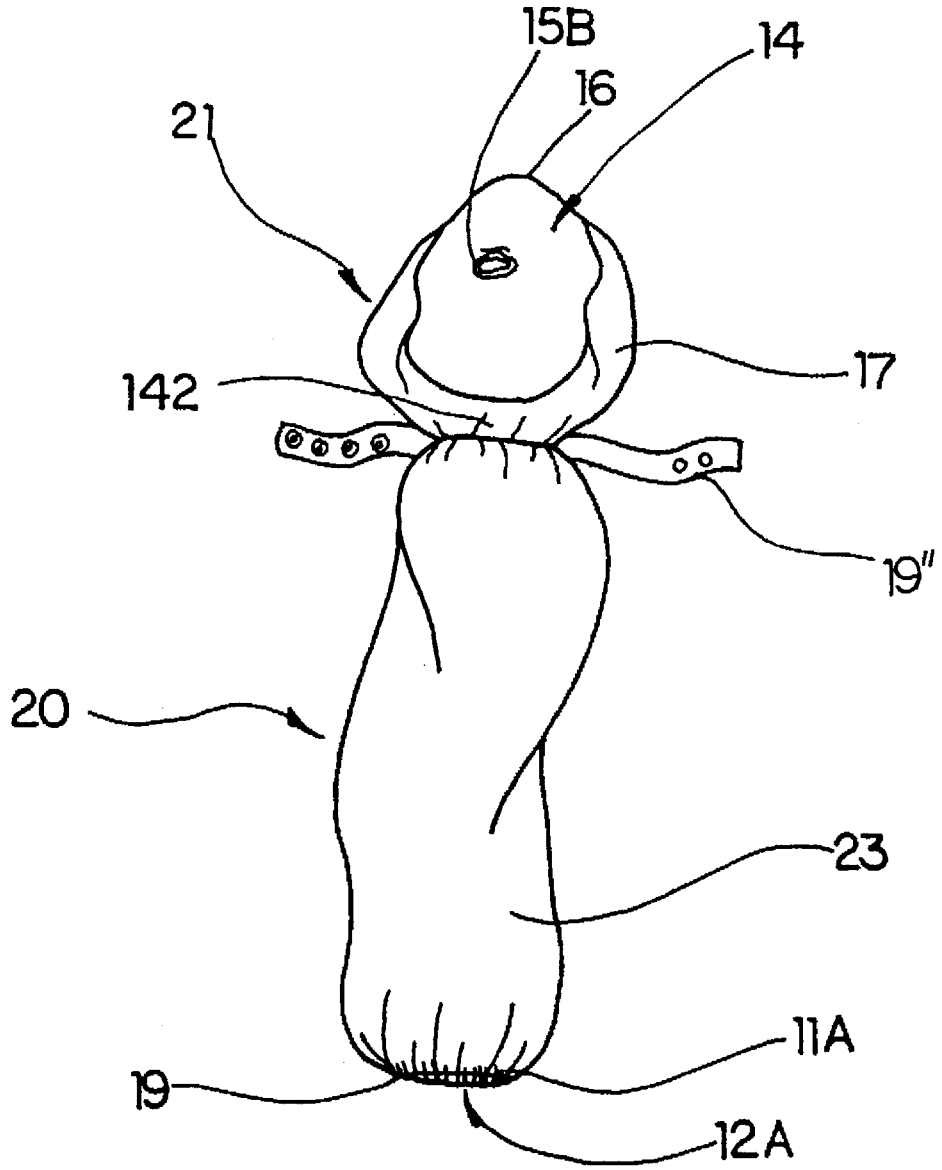

Referring to FIG. 6, the fastening elements of the present invention can be hook and loop fasteners, such as "VELCROS", 19' (as shown in FIG. **6*a*) or snap-on straps 19" (as shown in FIG. 6*b***) binding to said rear and from ends of said arm piece of the first embodiment or the middle portion between said arm segment and cuff segment of the second embodiment.

I claim:

1. An ultra violet protection sleeve, comprising an elongated tubular air ventilating fabric arm piece which defines a chamber like cavity therein and has two openings at a rear end and a front end of said arm piece respectively, said arm piece adapted to extend from a driver's upper arm down to the wrist area; said arm piece is constructed with at least two fastening elements to both said rear and front opening ends so as to fasten said rear and front opening ends of said arm piece to the upper arm portion and the wrist area of the driver for holding said arm piece in position;

a hand piece which comprises a prolonged tubular arm segment, a third fastening element and a hood and arch like cuff segment which has a top side, a bottom side and an open mouth defined therebetween; wherein said top side of said cuff segment is extended gently from said prolonged arm segment to a predetermined length that overlaps the entire back surface of the hand and fingers of the driver with its fringe ending over the tip of the driver's fingers for prohibiting the intrusion of ultra violet radiation; said bottom side of said cuff segment being extended from said arm segment to cover the driver's wrist and palm area, wherein the driver's hand is able to expose through said open mouth formed under said top side; said third fastening element being constructed between said arm segment and said cuff segment for holding said hand piece to the driver's wrist area and overlapping said arm segment upon said front end of said arm piece; and a holding means for connecting said cuff segment to the driver's hand by mounting on the driver's fingers.

2. An ultra violet protection sleeve, as recited in claim 1, in which said holding means comprises at least one elastic finger band attachment disposed within and across an internal surface of said top side of said cuff segment, whereby one of the driver's fingers is penetrated through said finger band attachment so as to hold the driver's hand in position underneath said cuff segment.

3. An ultra violet protection sleeve, as recited in claim 1, in which said holding means comprises at least three elastic finger band attachments disposed within and across an internal surface of said top side of said cuff segment, wherein two of said finger band attachments are respectively fixed near two side edges of said fringe of said cuff segment and the other finger band attachment is fixed at a center position of the internal surface to provide more gripping stability for the driver's hand and fingers, so that the driver's thumb, middle finger and little finger are penetrated through said three finger band attachments and the driver's hand is able to hold in position underneath said cuff segment.

4. An ultra violet protection sleeve, as recited in claim 1, in which said fastening elements are elastic bands.

5. An ultra violet protection sleeve, as recited in claim 1, in which said fastening elements are hook and loop fasteners binding to said rear and front ends of said arm piece and a middle portion between said arm segment and cuff segment of said hand piece.

6. An ultra violet protection sleeve, as recited in claim 1, in which said fastening elements are snap-on straps binding to said rear and front ends of said arm piece and a middle portion between said arm segment and cuff segment of said hand piece.

7. An ultra violet protection sleeve, comprising an elongated tubular air ventilating fabric arm piece which defines a chamber like cavity therein and has two openings at a rear end and a front end of said arm piece respectively, said arm piece adapted to extend from a driver's upper arm down to the wrist area; said arm piece is constructed with at least two fastening elements to both said rear and front opening ends so as to fasten said rear and from opening ends of said arm piece to the upper arm portion and the wrist area of the driver for holding said arm piece in position;

a hood and arch like cuff segment integrally extending from said front opening end of said arm piece so as to form a single piece, which has a top side, a bottom side and an open mouth defined therebetween; wherein said top side of said cuff segment is extended gently from said prolonged arm segment to a predetermined length that overlaps the entire back surface of the hand and fingers of the driver with its fringe ending over the tip of the driver's fingers for prohibiting the intrusion of ultra violet radiation; said bottom side of said cuff segment being extended from said arm segment to cover the driver's wrist and palm area, wherein the driver's hand is able to expose through said open mouth formed under said top side; and a holding means for connecting said cuff segment to the driver's hand by mounting on the driver's fingers.

8. An ultra violet protection sleeve, as recited in claim 7, in which said holding means comprises at least one elastic finger band attachment disposed within and across an internal surface of said top side of said cuff segment, whereby one of the driver's fingers is penetrated through said finger band attachment so as to hold the driver's hand in position underneath said cuff segment.

9. An ultra violet protection sleeve, as recited in claim 7, in which said holding means comprises at least three elastic finger band attachments disposed within and across an internal surface of said top side of said cuff segment, wherein two of said finger band attachments are respectively fixed near two side edges of said fringe of said cuff segment and the other finger band attachment is fixed at a center position of the internal surface to provide more gripping stability for the driver's hand and fingers, so that the driver's thumb, middle finger and little finger are penetrated through said three finger band attachments and the driver's hand is able to hold in position underneath said cuff segment.

10. An ultra violet protection sleeve, as recited in claim 7, in which said fastening elements are elastic bands.

11. An ultra violet protection sleeve, as recited in claim 7, in which said fastening elements are hook and loop fasteners binding to said rear and front ends of said arm piece.

12. An ultra violet protection sleeve, as recited in claim 7, in which said fastening elements are snap-on straps binding to said rear and front ends of said arm piece.

13. An ultra violet protection sleeve, comprising a hand piece which comprises a prolonged tubular arm segment, a fastening element and a hood and arch like cuff segment which has a top side, a bottom side and an open mouth defined therebetween; wherein said top side of said cuff segment is extended gently from said prolonged arm segment to a predetermined length that overlaps the entire back surface of the hand and fingers of the driver with its fringe ending over the tip of the driver's fingers for prohibiting the intrusion of ultra violet radiation; said bottom side of said cuff segment being extended from said arm segment to cover the driver's wrist and palm area, wherein the driver's hand is able to expose through said open mouth formed under said top side; said fastening element being constructed between said arm segment and said cuff segment for holding said hand piece to the driver's wrist area; and a holding means for connecting said cuff segment to the driver's hand by mounting on the driver's fingers.

14. An ultra violet protection sleeve, as recited in claim 13, in which said holding means comprises at least one elastic finger band attachment disposed within and across an internal surface of said top side of said cuff segment, whereby one of the driver's fingers is penetrated through said finger band attachment so as to hold the driver's hand in position underneath said cuff segment.

15. An ultra violet protection sleeve, as recited in claim 13, in which said holding means comprises at least three elastic finger band attachments disposed within and across an internal surface of said top side of said cuff segment, wherein two of said finger band attachments are respectively fixed near two side edges of said fringe of said cuff segment and the other finger band attachment is fixed at a center position of the internal surface to provide more gripping stability for the driver's hand and fingers, so that the driver's thumb, middle finger and little finger are penetrated through said three finger band attachments and the driver's hand is able to hold in position underneath said cuff segment.

16. An ultra violet protection sleeve, as recited in claim 13, in which said fastening element is an elastic band.

17. An ultra violet protection sleeve, as recited in claim 13, in which said fastening element is a hook and loop fastener binding to a middle portion between said arm segment and said cuff segment.

18. An ultra violet protection sleeve, as recited in claim 13, in which said fastening element is a snap-on strap binding to a middle portion between said arm segment and said cuff segment.

19. An ultra violet protection sleeve, as recited in claim 13, in which said sleeve is a highly flexible air flow with soft air ventilating fabric that provides air circulation therein.

* * * * *